United States Patent [19]

Cicin-Sain et al.

[11] Patent Number: 4,606,274

[45] Date of Patent: Aug. 19, 1986

[54] TRAVELLING RAILROAD TIE REMOVAL MACHINE

[75] Inventors: Ivo Cicin-Sain, Bussigny; Tibor Aubermann, Vevey, both of Switzerland

[73] Assignee: Matisa Materiel Industriel S.A., Crissier, Switzerland

[21] Appl. No.: 629,218

[22] Filed: Jul. 10, 1984

[30] Foreign Application Priority Data

Jul. 15, 1983 [CH] Switzerland ..... 3892/83

[51] Int. Cl.[4] ..... E01B 29/10

[52] U.S. Cl. ..... 104/6; 104/2; 414/551

[58] Field of Search ..... 104/2, 9, 6; 414/551, 414/552

[56] References Cited

U.S. PATENT DOCUMENTS

| | | | |
|---|---|---|---|
| 2,797,064 | 6/1957 | Abbott | 104/7 R |
| 3,127,847 | 4/1964 | Sivon | 104/2 |
| 3,675,580 | 7/1972 | Kershaw | 104/9 |
| 4,204,476 | 5/1980 | Cicin-Sain | 104/2 |
| 4,207,820 | 6/1980 | Cicin-Sain | 104/2 |
| 4,236,452 | 12/1980 | Theurer et al. | 104/2 |
| 4,253,398 | 3/1981 | Theurer et al. | 104/2 |
| 4,258,626 | 3/1981 | Theurer et al. | 104/6 |

FOREIGN PATENT DOCUMENTS

| | | | |
|---|---|---|---|
| 19414 | 4/1929 | Australia | 414/551 |
| 594105 | 12/1977 | Switzerland . | |
| 600047 | 6/1978 | Switzerland . | |

*Primary Examiner*—Robert B. Reeves
*Assistant Examiner*—Carol L. Olson
*Attorney, Agent, or Firm*—Robert E. Burns; Emmanuel J. Lobato; Bruce L. Adams

[57] ABSTRACT

A tie lifting machine comprises a reciprocating tie removing member provided with retractable push fingers for removing the ties from the ballast and pushing them onto an upwardly inclined ramp to an intermediate position, a fork-like tie lifting member adapted to lift the ties from the intermediate position up to a belt conveyor running in the direction of travel of the machine, and a tie pusher adapted, when the tie lifting member is in its upper position, to transfer the ties carried by this member to the belt conveyor.

22 Claims, 17 Drawing Figures

45
46
47
50
48
49
33
31
30
4
32
26
51
6a
5

TRAVELLING RAILROAD TIE REMOVAL MACHINE

FIELD OF INVENTION

This invention relates to a travelling machine for removing railroad ties, more particularly in a track renewal train, with a first device for extracting the ties from the track ballast and a second device for lifting the ties and laying them upon an endless belt conveyor running in the direction of travel of the machine above the first device.

PRIOR ART

In a known railroad tie removal machine of this character (U.S. Pat. No. 4,236,452) the first tie removal device consists of a gripping device adapted on the one hand to swivel about an axis transverse to the track, with its grippers extending in the direction of travel of the machine and on the other hand, during the travel of the machine, to engage from underneath the ties embedded in the ballast and lift them somewhat. The second device consists of a vertical conveyor provided with catch means for the ties, which takes over the ties from the gripping member, lifts them and deposits them upon the rear end of a horizontal belt conveyor extending in the longitudinal direction. A faultless operation of this machine during the uniformly driven track renewal train is obtained when the distance between the ties to be removed remains constant and when no double ties, that is, two closely adjacent ties, are encountered, otherwise the trouble-free and regular removal of successive ties by the tie gripping members of the vertical conveyor cannot be warranted. Besides, the proper guiding of the ties, notably the lateral alignment thereof, is by no means reliable during the tie lifting operation.

It is also already known, for the removal of old ties, to provide a wheel rotatable about a horizontal axis and equipped with tie removal means adapted to release the ties from the ballast and to carry them during a half-revolution, before depositing them upon a horizontal belt conveyor (CH-PS No. 600,047). In this case the ties are delivered to the conveyor after rotating through 180 degress about their horizontal longitudinal axis.

Furthermore, a track renewal train with a tie removal device is also known (CH-PS No. 594,105) which comprises on the one hand a rotary wheel with radially projecting grippers for releasing and lifting the ties from the ballast and on the other hand a belt conveyor with catches which is disposed tangentially to said wheel and is strongly inclined upwards. This conveyor takes over the ties lifted by the wheel grippers and rises to a level above that of the device provided for laying the new ties, so as to deposit the old ties upon another, substantially horizontal belt conveyor. This last-mentioned conveyor, like the conveyor for supplying the new ties, extends in the direction opposite the direction of travel of the machine, a feature frequently detrimental for reasons of space.

SUMMARY OF THE INVENTION

This invention is directed to solve the problem of developing a tie removal machine of the type broadly set forth hereinabove, which is capable, during the progress of the machine at a uniform speed, of removing not only individual ties but also double ties, independently of the frequently changing distance between adjacent ties and of the condition and material of the ties and ballast, and laying the ties upon the longitudinal belt conveyor in a trouble-free manner, without any risk of jamming and without turning the ties carrying as a rule on their top surface bed plates, notably ribbed plates.

This problem is solved in that the travelling railroad tie removing machine, according to the present invention, notably in a track renewal train, comprises a first device for extracting the ties from the track ballast, behind said first device, as seen in the direction of travel, an upwardly inclined ramp for picking up the ties, and a second device for lifting the ties up to a belt conveyor extending over the first device in the direction of travel of the machine, the first device being so arranged as to move the ties on said ramp in an intermediate position, said second device consisting of a fork-shaped pivoted tie lifting member and of a tie pusher, said tie lifting member being adapted to pivot between a lower position located beneath said intermediate position and an upper position flush with said belt conveyor about a horizontal axis that extends on the side of said intermediate position which is opposite said first device, said tie pusher being so arranged that in the upper position of said tie lifting member it can push the tie or ties supported by this member onto said belt conveyor.

Thus, a tie removal machine will be obtained whereby the release of the ties from the ballast, the lifting of the ties and the slipping of the ties on the belt conveyor are each performed by separate, controllable members of simple construction, permitting a well-defined operation which is also trouble-free even in case of variations in the distance between ties.

To lift the ties out from the track ballast and cause them to slip onto the upwardly inclined ramp, a pick-up member is provided, preferably, which is adapted to pivot to and fro by means of a driving arrangement about a horizontal axis and comprises push-fingers responsive to drive members; advantageously, this driving arrangement has substantially the shape of a semi-circular disc, but it may also have if necessary the form of a lever pivoting to and fro. According to another form of embodiment, the driving member consists of a wheel rotating continuously or intermittently, and provided with resiliently engageable push-fingers.

The driving member may be controlled manually from time to time by the operator on the machine, in order to take due account of irregularities in the distance between adjacent ties. The fork-shaped tie removal lifter, operating like a lever, permits, in contrast to vertical conveyors, of removing without any modification also double ties, so that it is unnecessary to break the working process.

In order properly to guide the ties during their travel on the ramp and during the lifting thereof, guide plates with suitably shaped lower and rear edges acting as guide edges may be provided. In a preferred form of embodiment, the arrangement is such that the driving member has the shape of a wheel or approximately of a semi-circular disc, with its periphery extending parallel to the upper side, arched to a circular arc configuration, of the ramp, so as to define therewith a guideway for the ties. This guideway will be bounded with an upward inclination on the one hand by means of guide rails and on the other hand by means of guide levers. When a tie has been driven by a push-rod to a sufficient height and is supported by the guide levers, these levers together with the tie are pivoted downwards so that the tie can be taken over by the tie lifter with the proper orientation in view of a subsequent transfer.

The machine parts supporting the axle of the driving member are preferably suspended for vertical movement from the machine frame and adapted to be subjected to a predetermined downward force by means of a pressure member.

Advantageous forms of embodiment of the invention are illustrated in the attached drawings.

BRIEF DESCRIPTION OF THE DRAWINGS

The invention will now be described more in detail with reference to the accompanying drawings showing several forms of embodiment given by way of example. In the drawings.

DESCRIPTION OF THE PREFERRED EMBODIMENTS

Figure 1:
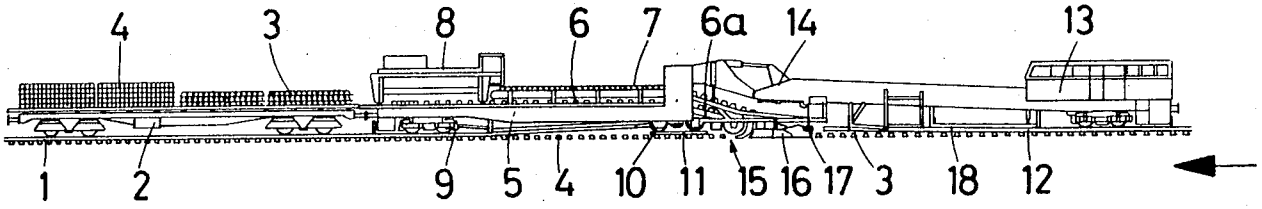
FIG. 1 is a diagrammatic illustration of a track renewal train, equipped with a tie removal machine according to the invention.

As shown in FIG. 1 the track renewal train travelling in the direction of the arrow comprises at its leading end, on the old track 1, rolling transfer cars 2 for the new ties 3 to be laid and the old ties 4 removed from the track ballast. Before operating the track renewal train the means for fastening the rails 1 of the old track have already been loosened. The transfer cars 2 are followed by a working car 5 with equipment for removing the old rails, which are suspended and adapted to be lowered on both sides of the track bed, with a longitudinally extending belt conveyor 6 for the old ties 4, and having its initial section **6*a* inclined forwards and downwards, and overlying this conveyor another longitudinal belt conveyor 7 for the new ties 3. Since the tie transfer car 2 is at the leading end of the train, a feature advantageous for reasons of space, both belt conveyors 6 and 7 extend along the first or leading section of the train. A portal crane 8 for transferring the ties movable or running rails forming a continuous track over the working car 5 and the transfer car 2 is provided, these rails being movable along the two cars. The working car 5 rolls with its front bogie 9 on the old track 1, while its rear bogie 10 is supported by a cradle 11 adapted to slip on the old tie 4** still present on top of the ballast.

Between the rear end of working car 5 and the driving car 13 rolling at the rear end of the track renewal train on the new track 12 is a supporting frame 14 on which the tie removal machine 15, to be described more in detail presently, with the inclined initial section **6*a* of belt conveyor 6 for the old ties 4, a ballast regulator 16 for spreading the ballast, a device 17 for lowering the new ties 3 with the inclined rear section of feed conveyor 7 for said new ties, and a device 18 for transferring the new rails constituting the new track 3** are installed; these new rails are deposited on both sides of the track before setting the track renewal train on operation.

Figure 2:
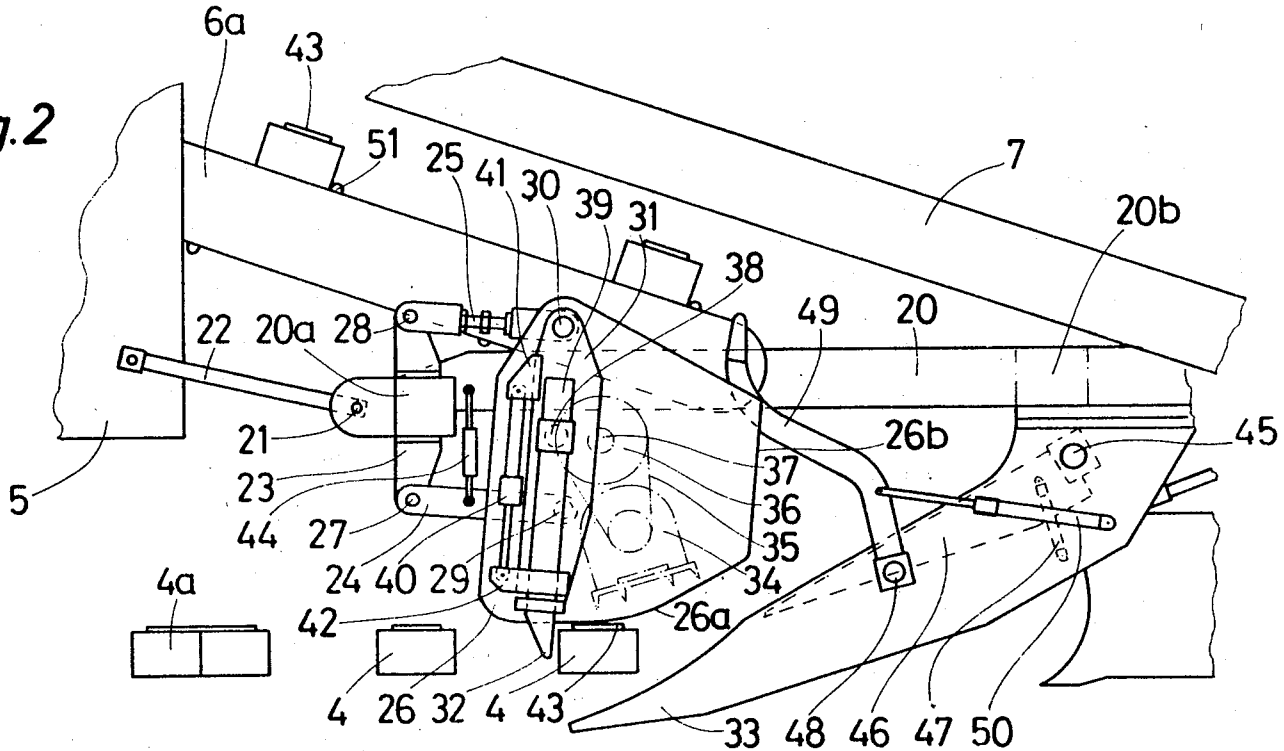
FIG. 2 is a diagrammatical, considerably enlarged side view of the tie removal machine in which all parts not necessary for the proper understanding of the invention have been omitted.
Figure 3:
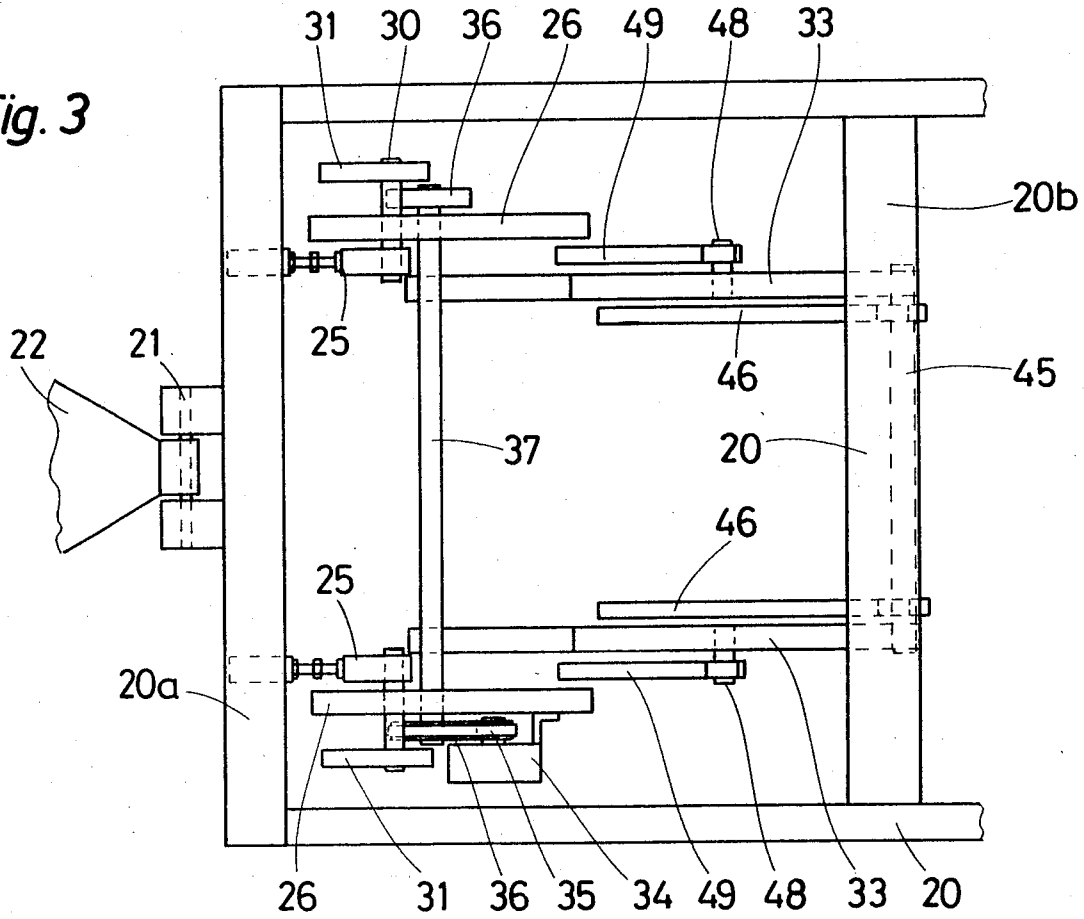
FIG. 3 is a diagrammatic plan view from above of the machine of FIG. 2, wherein again all the parts not essential for the invention are not shown.

FIGS. 2 and 3 show diagrammatically the tie removal machine 15, in side view and plan view from above, respectively. However, only the parts essential for a proper understanding of the invention are shown. All these parts are mounted in a frame 20 of which the front side **20*a* is pivotally connected to a horizontal axis 21 coupled to a connecting member 22 pivotally connected in turn to the rear end of the frame structure of working care 5. Secured to the front side 20*a* of frame 20 and disposed, symmetrically to the median line of this front side are two vertical carrier members 23 to which each one of a pair of guide plates 26 are mounted for vertical adjustment by means of two pivoted arms 24 and 25. Both arms 24 and 25 are pivotally connected by means of pivot pins 27 and 28 to the lower and upper ends of each carrier members 23, whereas each guide plate 26 is pivotally connected via pivot pins 29 and 30 to the other ends of arms 24 and 25. Therefore, the assembly constitutes a parallelogram suspension for the vertically movable guide plates 26**.

In the plan view of FIG. 3, showing the upper arms 25 of the aforesaid parallelogram suspension, one sees that the above-described installation and the component elements, still to be described, of the tie removal machine are disposed substantially symmetrically on either side of the median line in their built-on condition, so that the elements corresponding to each other are designated by the same reference numerals.

Fulcrumed to the upper pivot pin 30 of the parallelogram suspension is a driving member 31 supporting a controllable sliding and retractable push finger 32 which, when the driving member 31 is rotated counterclockwise from the position of FIG. 2, releases from the ballast an old tie 4 still embedded therein and pushes this tie backwards in the direction opposite the direction of travel of the track renewal train. Then, the old tie 4 slips on an inclined fork-shaped ramp 33 consisting of a pair of vertically disposed plates supported by a rear cross-member **20*b* of frame 20. The working position of this ramp 33 can be firmly set at a desired height according to working requirements. The distance between a lower edge 26*a* of guide plate 26, which constitutes a guide edge for the old ties 4, and ramp 33 corresponds, as shown in FIG. 2, to the height of the old ties 4, which in this way will be guided in a well-defined manner during their transfer by means of driving member 31**.

For moving the driving member 31 to and from about the axis 30 a crank gear driven by a motor 34 is provided. This crank gear comprises a wheel 36 driven through a transmission belt 35 from motor 34, keyed on a transverse shaft 37 rotatably mounted in bearings carried by guide plates 26, said shaft comprising a crankpin 38 adapted to slide in a longitudinal groove 39 formed in the driving member 31. On the other side of transverse shaft 37 a corresponding wheel 36 is keyed for driving the other driving member. For actuating the retractable push finger 32 a hydraulic cylinder 40 mounted in a longitudinal position on driving member 31 is pivotally connected on one side to a fixed projection 41 of driving member 31 and on the other side to a slide 42 secured to, and adapted to move along, said push finger 32.

In the rear portion of the vertically disposed plate in which the ramp 33 is formed a pivot shaft 45 is journalled and has secured thereto a pair of swinging levers forming a fork-shaped tie-lifting member 46. This tie-lifting member 46, extending therefor from its pivot pin 45 in the feed direction of the machine, has in its lower position, shown in FIGS. 4 and 5, the same inclination as ramps 33 and lies at the same level as these ramps 33 or somewhat beneath the ramp plane. In this position the tie lifting member 46 lies somewhat beneath the intermediate position 4' (FIG. 4) assumed by an old tie 4 after the latter has been moved by the driving member 31 up ramp 33. By means of a hydraulic cylinder 47 pivotally connected at one end to frame 20 and at the other end to tie-lifting member 46, the latter can pivot about the shaft 45 in the upper position illustrated in FIG. 5, in which this member 46 is substantially flush with the section 6a of the longitudinally extending belt conveyor 6.

The inclination of ramp 33, which in the example illustrated is about 30°, and the angular movement of tielifting member 46, representing in the example illustrated about 50°, are so selected that the ties 4, during their movements, cannot exceed a cant of about 45° to the horizontal.

Figure 4:
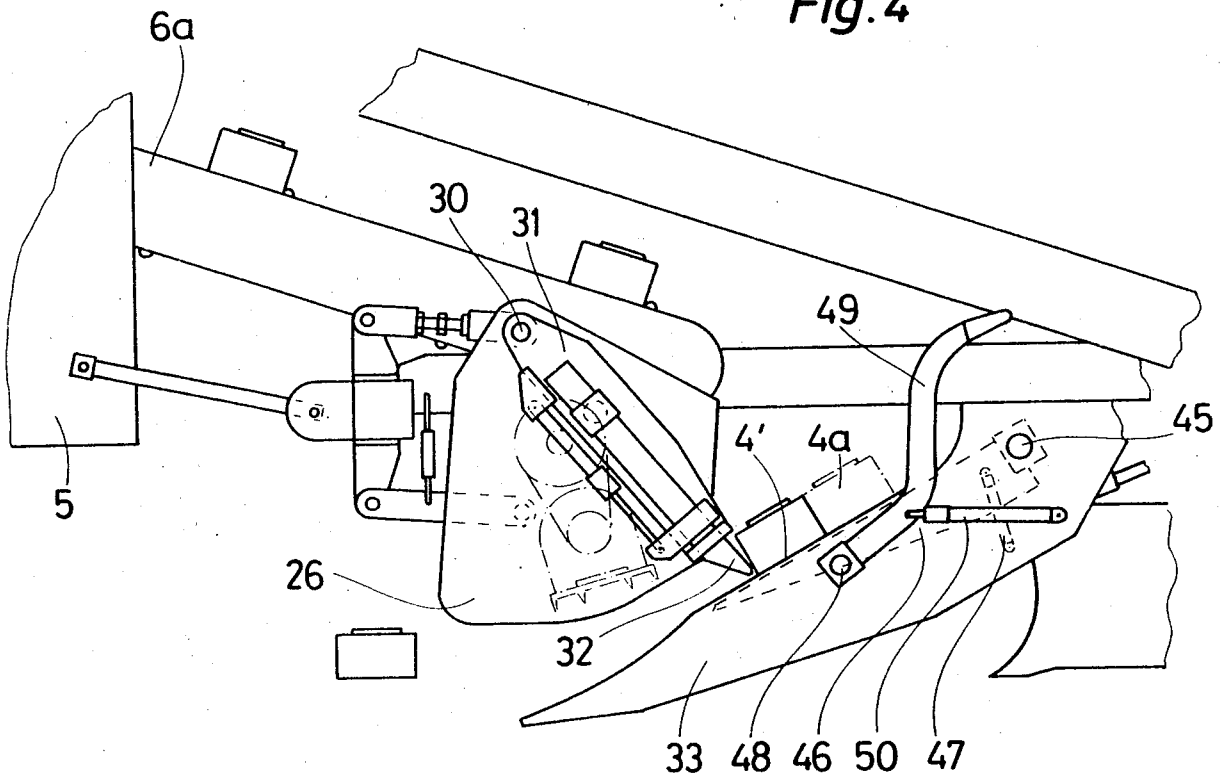
FIGS. 4 and 5 show the machine of FIG. 2 during the second and third steps of its operation.
Figure 5:
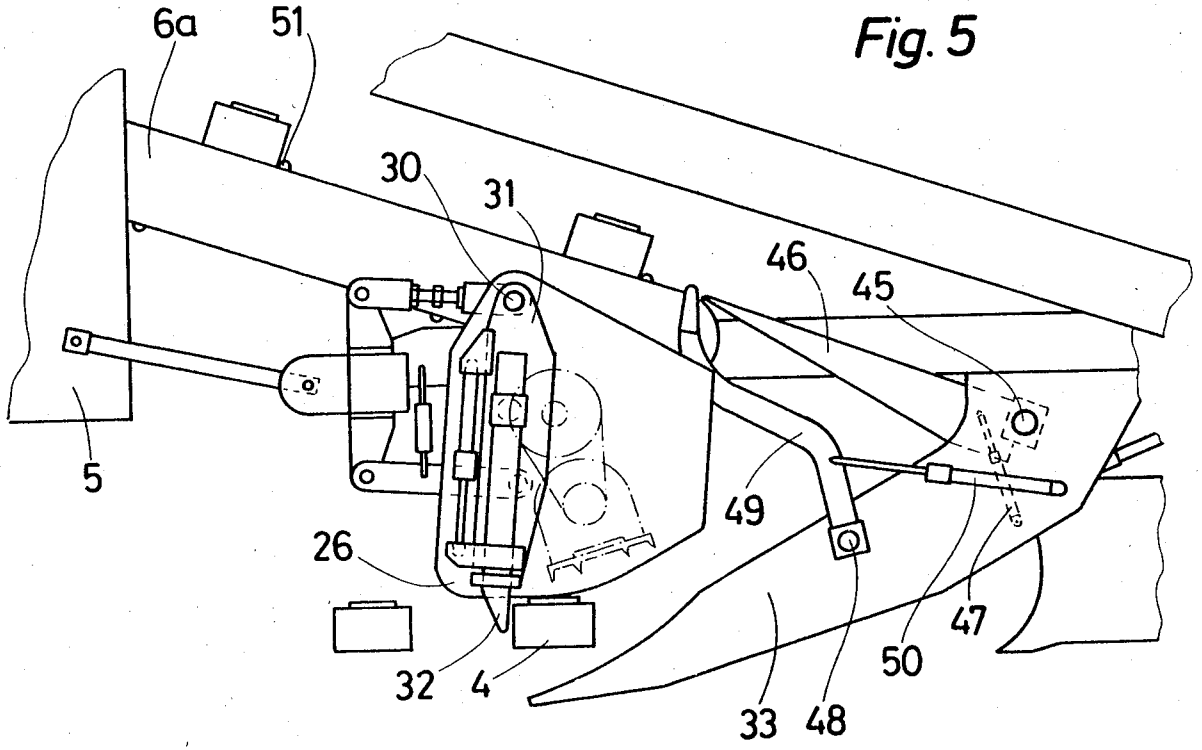

In the intermediate section of each one of the plates constituting said ramps 33 a lever acting as a tie-pusher 49 is pivoted by means of a pivot pin 48; this lever, with the assistance of a hydraulic cylinder 50 pivoted at one end to the frame 20 or to the ramp 33, and at the other end to the tie pusher 49, is adapted to pivot between the foremost position shown in FIGS. 2 and 5 and the rearmost position shown in FIG. 4, for the purpose of transferring a lifted tie 4 off of the tie-lifting member 46 onto the belt conveyor 6a.

In order to constantly press the guide plates 26 together with the driving member 31 with a predetermined downward force, a pressure member 44 in the form of a hydraulic cylinder is provided which, as shown in FIG. 2, is pivotally connected on the one hand to one element of frame 20 and on the other hand to the lower arm 24 of said parallel suspension. Thus, the driving member 31 with its push finger 32 bears constantly and sufficiently deeply against the back of the tie 4 and furthermore the guide plates 26 engage with their lower edges 26a the tie transferred to the ramp 33 and more particularly the groove or hollow contour of the ground plates 43 fixed on the old tie 4, notably ribbed plates, in order to improve the lateral guiding of said ties 4 up the ramp 33. Of course, such a pressure member 44 is not alway necessary, so that it is also possible to dispense therewith should the occasion arise. In addition, it is possible to cause this pressure member to act only upon the driving member 31, so that the latter will be pressed downwards with a predermined force, while the guide plates 26 remain fixed in relation to the frame 20, though they are preferably vertically adjustable as a function of specific working conditions.

Now a more detailed description of the mode of operation of the above-described tie removal machine will be given with reference to FIGS. 2, 4 and 5 showing three different working steps thereof. In the illustration of FIG. 2 the driving member 31 and its push finger 32 are in their initial position, that is, in the tipped position in the direction of travel of the machine, and ready to engage an old tie 4 and release same from the ballast and push same onto the ramp 33. The tie lifting member 46 assumes its lower position for picking up the tie. The tie pusher 49, which has transferred to the conveyor 6a the preceding tie picked up from the tie lifting member 46 and supported thereby, assumes then the forward inclined position in which it is about to be tipped backwards.

In the condition shown in FIG. 4 the driving member 31 has pushed the tie 4 to its intermediate position 4' on ramp 33 and has thus attained its endmost tipped position. The tie lifting member 46 is still in its lowermost position in which it engages the tie 4 from beneath. Meanwhile, the tie pusher 49 has beenn tipped back to its rearmost position. Then the tie lifting member 46 with tie 4 is tipped to its upper position, while the driving member 31 is tipped back to its initial position, so that the push finger 32 is retracted simultaneously by means of the hydraulic cylinder 40 and can thus clear the next tie to be picked up.

In the condition shown in FIG. 5 the tie lifting member 46 is in its uppermost position in alignment with the rear section 6a of conveyor 6, and the tie pusher 49 has already pivoted back to its foremost position, so that the tie 4 picked up by tie lifting member 46 is laid upon the rear end of conveyor 6a. This conveyor is provided preferably with transverse ribs 51 in order better to carry along the ties 4. The driving member 31 is in its output position behind the next tie 4 to be picked up, and in this position its push finger 32 is already pushed again downwards by hydraulic cylinder 40. Subsequently, the tie lifting member 46 is tipped back to its lowermost position, in which the next tie 4 can be transferred upon the ramp 33 to its intermediate position 4', and so forth.

The length of the intermediate section of ramp 33 corresponding to the intermediate position 4' as well as that of the corresponding section of tie lifting member 46 are so calculated that also double ties can be picked up, simultaneously, lifted, laid upon conveyor 6a and transferred thereby. In FIGS. 2 and 4 a double tie 4a is shown in dash and dot lines in the ballast and on the tie lifting member 46.

Figure 6:
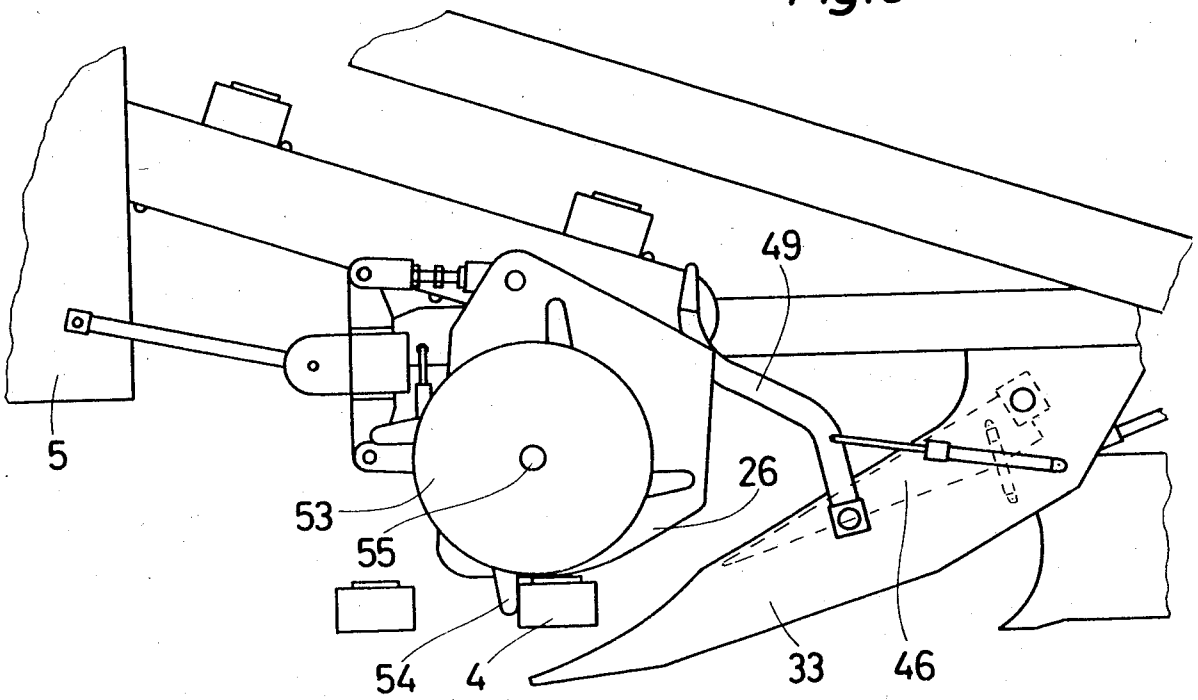
FIG. 6 is a diagrammatic side view of a second form of embodiment of the invention.

In a second form of embodiment shown diagrammatically in FIG. 6 the pick-up member is shown in the form of a wheel 53 rotating continuously or intermittently and provided in the example illustrated with four spring-loaded push fingers 54 disposed at spaced angular intervals along the wheel periphery. The axis of rotation 55 of this wheel 53 is journalled in guide plates 26 and driven by a motor in a manner not shown. All the other component elements of this second form of embodiment correspond to those of the first form of embodiment, so that only the contour of guide plates 26 is adapted to the path followed by the ties during their transfer.

Figure 7:
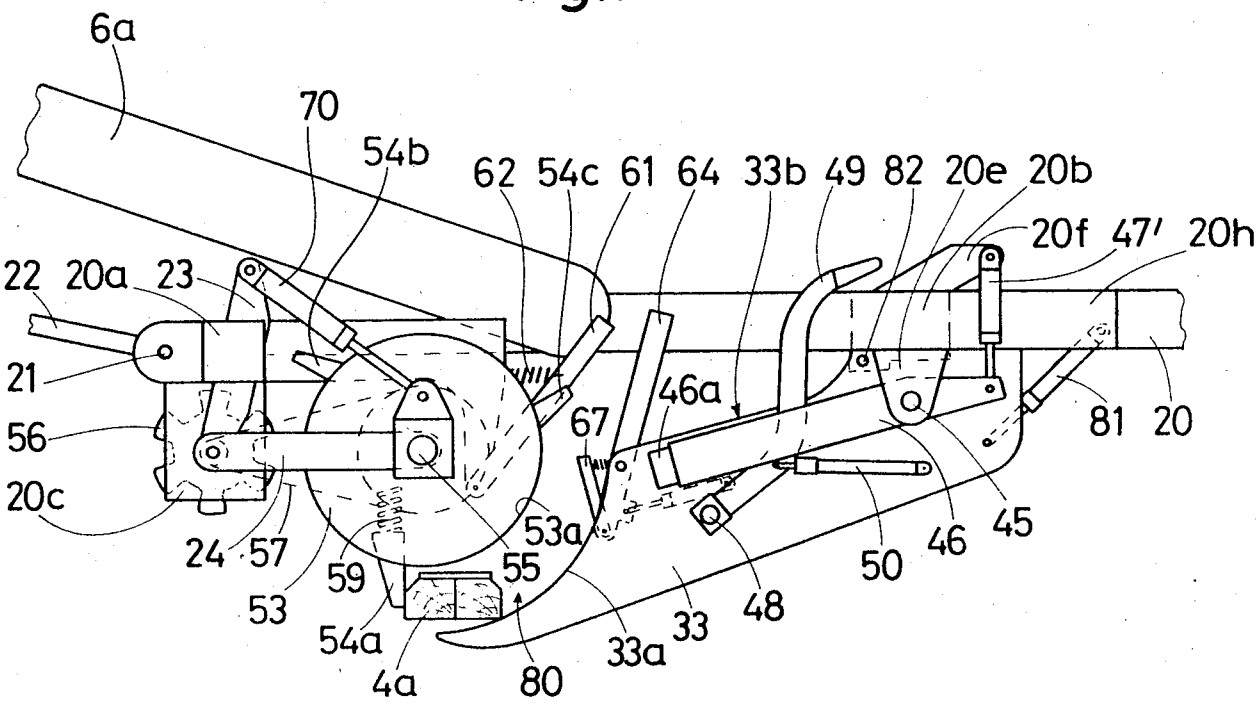
FIG. 7 is similar to FIG. 2 and shows a corresponding enlarged side view of a third form of embodiment of the invention, as seen in the direction of the arrows VII of FIG. 8.
Figure 12:
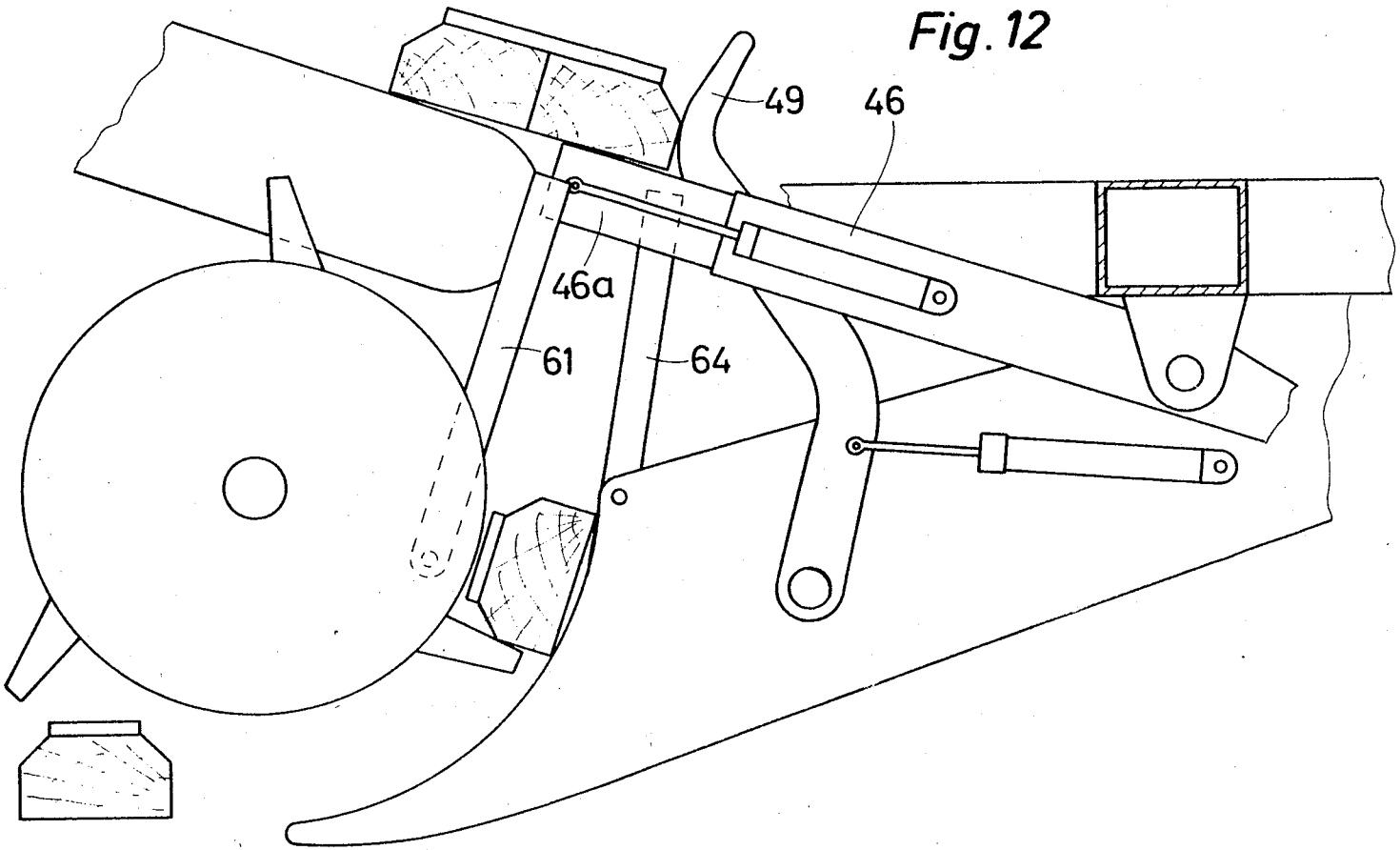
Figure 13:
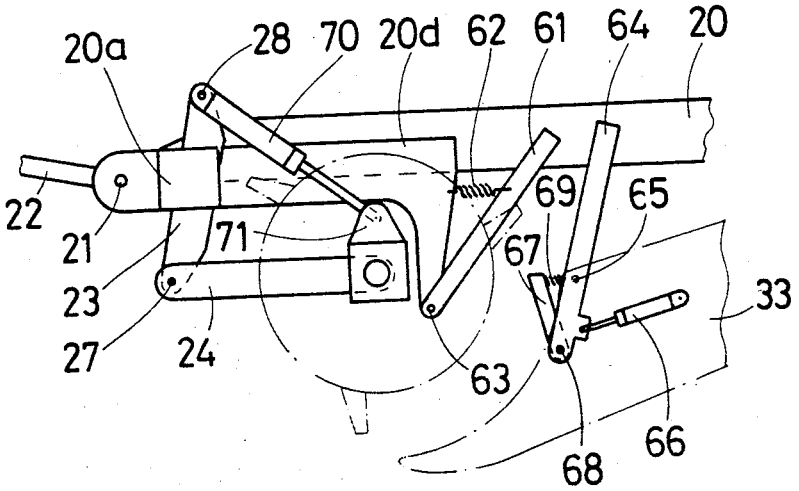
FIGS. 13 and 14 are diagrammatic side elevational views of details of the machine of FIG. 7.
Figure 14:
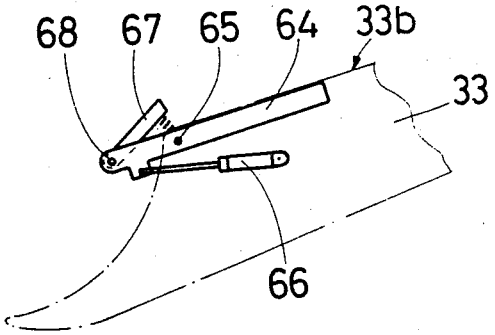

FIGS. 7 to 15 show a third, improved form of embodiment, in which all the component elements which are either the same as or correspond to those of the example shown in FIGS. 1 to 6 are designated by the same reference numerals. In FIGS. 7 and 13 the tie removal machine comprises again as a tie lifting member a wheel 53 provided with three push fingers 54*a*, 54*b* and 54*c* uniformly spaced about the wheel periphery, which are adapted to be pushed radially inwards against the resistance of springs 59. The wheel 53 is keyed to a shaft 55 adapted to be driven from a motor 56, notably a hydraulic motor, mounted on a beam 20*c* of frame section 20*a*, the rotary motion being transmitted via a belt 57 to a driving wheel 58 (FIG. 8) rigid with said shaft 55.

The ramp 33 differs somewhat from the one of the preceding form of embodiment and comprises on its portion facing the wheel 53 an upper, concave and tie-receiving face constituting a receiving surface for the ties, which is substantially parallel to the periphery 53*a* of wheel 53 and thus defines with this wheel periphery 53*a* a concave guideway 80 for the ties. The extension of the concave upper face 33*a* of ramp 33 consists of a substantially straight upper face 33*b* slightly inclined against the direction of travel of the machine.

Secured to each lengthening members 20*d* on either side of frame section 20*a* (FIGS. 8 and 13) is a guide rail 61 so disposed that it extends at least approximately tangent to the wheel periphery 53*a*, obliquely upwards, and thus distances further off the upper limit of guideway 80 which is defined by the wheel periphery 53*a*. Each guide rail 61 is mounted for pivotal movement in the direction of travel of the machine, therefore to the left as seen in FIG. 13, and for this purpose it can oscillate by having its lower end pivoted about a pivot pin 63 carried by an insert 20*d* and its other end pivotally connected to one end of a spring 62 having its other end anchored to said insert 20*d*, this spring being adapted to be compressed by a force acting on guide rail 61 in the direction of travel of the machine.

Figure 8:
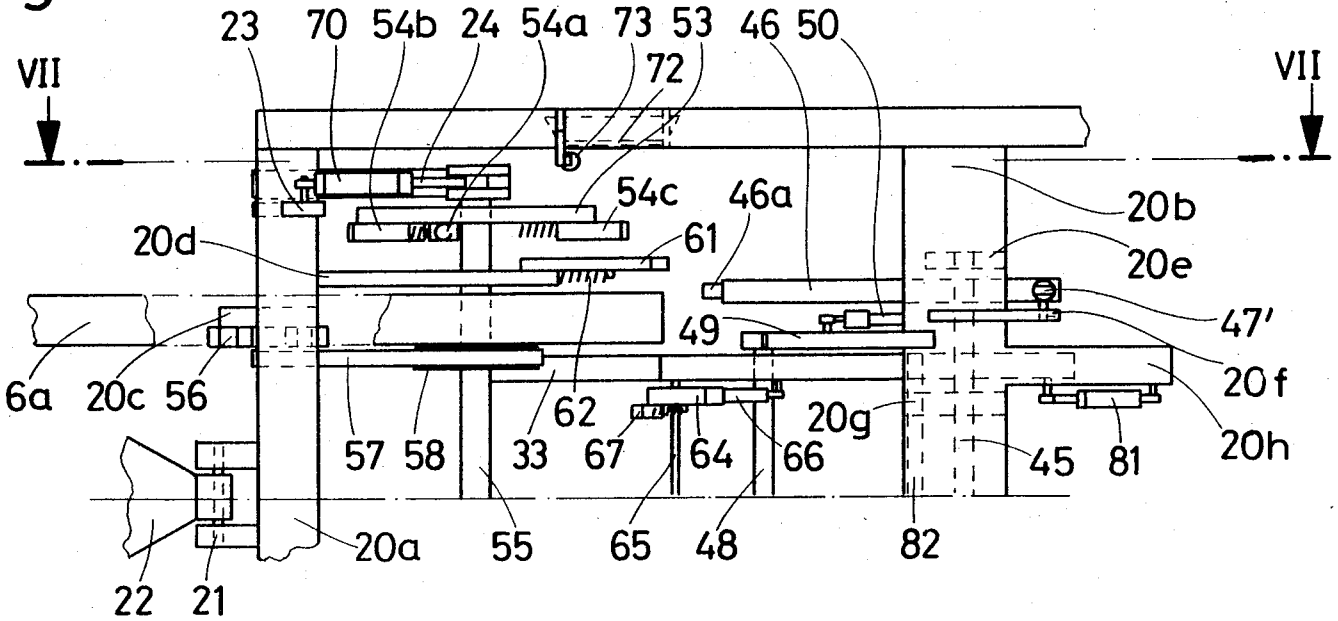
FIG. 8 is similar to FIG. 3 and shows a corresponding plan view from above of the machine of FIG. 7, wherein only one-half of the symmetrically constructed machine is illustrated.

In the area of the upper ends of the concave sides 33*a* of ramps 33, and in close vicinity of the two vertical plates constituting said ramps 33, a two-armed guide lever 64 is pivotally mounted, the two levers 64 being fulcrumed on a common horizontal shaft 65 journalled in both ramp forming plates. The guide levers 64 are adjustable between a first, strongly inclined position shown in FIGS. 7 and 13, in which they are at least nearly parallel to guide rail 61 and lengthen the lower limit of the guide path, and a slightly inclined position shown in FIG. 14, in which their upper sides are substantially coplanar with the upper side 33*b* of ramp 33 or slightly below this upper side 33*b*. For tipping each guide lever 64 a hydraulic cylinder 66 shown in FIGS. 8 and 13 is provided, this cylinder being pivotally connected to the corresponding ramp plate. A pawl 67 projecting beyond the guide path 80 is pivoted to the lower lever arm of each guide lever 64 by means of a pivot pin 68 and responsive to a return spring 69. The function of this pawl 67, as will be explained presently, is to prevent the backward slipping of a tie driven by one of the push fingers of wheel 53 along the guide path up to this pawl. By virtue of the guide rails 61 and of the strongly upwardly inclined position of guide lever 64, this guide path will thus be extended in the upward direction, whereby the guide levers 64 will have at the same time the function of dropping a tie supported thereby in any intermediate position in which it can be taken over by the tie pick-up member 46, as will be further described presently.

The driving member consisting of wheel 53, as disclosed in connection with the first form of embodiment, is yieldingly suspended in the vertical direction from a mechanism somewhat simplified with respect to the parallelogram suspension of the first form of embodiment. As shown in FIGS. 7 and 13, it consists likewise of two substantially horizontal arms 24 pivotally connected at one end to the lower end of carrier members 23 about a pivot pin 27 and at the other end to the shaft 55 of wheel 53, and furthermore of two hydraulic cylinders 70 pivotally connected at one end by means of pivot pin 28 to the upper end of the relevant support 23 and the other end to the projecting yoke 71 rigid with shaft 55. By properly actuating the hydraulic cylinders 70 with a predetermined pressure, a corresponding downward force will be exerted on shaft 55 and consequently on wheel 53 which will thus be strongly pressed against the ballast. Therefore, in comparison with the form of embodiment of FIG. 2, the specific functions of upper arms 24 and pressure member 44 are combined in hydraulic cylinders 70.

Both levers constituting the tie lifting member 46 are rigidly mounted on a common horizontal shaft 45 journalled, in this case, in brackets 20*e* rigid with the cross member 20*b* of machine frame 20. Correspondingly, the hydraulic cylinders 47' actuating the tie lifting member 46, which are pivotally connected through their piston rods to the rear ends of said member 46, are pivotally connected through their cylinder bodies to a projection 20*f* of said cross member 20*b* (FIGS. 7 and 8). In the rear section of the upper portion 33*b* of ramp 33 recesses are provided for engagement by shaft 45. In the example concerned the tie lifting member 46 comprises, at the front ends of its two levers, telescopic extension elements 46*a* which, as shown diagrammatically in FIGS. 9–12, are adapted to be actuated by hydraulic cylinders 77. In this example, the adjustable length of tie lifting device 46 is therefore necessary, for in its lower inoperative position (FIGS. 7 and 9) it must not engage the guideway 80, and in its upper or tie-lifting position it must bridge the distance to conveyor 6*a*. To this end, the telescopic sections 46*a* are retracted in the inoperative lower position, and in the upper or tie-lifting position the tie lifting devices are fully extended. Possibly, the tie-lifting member 46 may, already during the picking up of a tie by means of guide lever 64, be somewhat extended in its lower position in order to provide a safe seat for this tie, as shown in FIG. 10; then, during the upward movement, the telescopic sections 46*a* can be further extended.

Both levers constituting the tie-pusher 49 are rigid with a common horizontal shaft 48 journalled in the plates of ramp 33. Their adjustment is provided by hydraulic cylinders 50 pivotally connected on the one hand to the ramp plates 33 and on the other hand to the levers of tie-pusher 49.

The mode of operation of the above-described machine will now be described with reference to FIGS. 9 to 12 illustrating the transfer of a double tie. This example is chosen for proving that the machine is also capable of handling ties having twice the width of a standard tie. In the diagrammatic illustration of FIGS. 9–12, which corresponds basically to the front view of FIG.

7, only the parts necessary for understanding the operation are shown for the sake of simplification.

Figure 9:
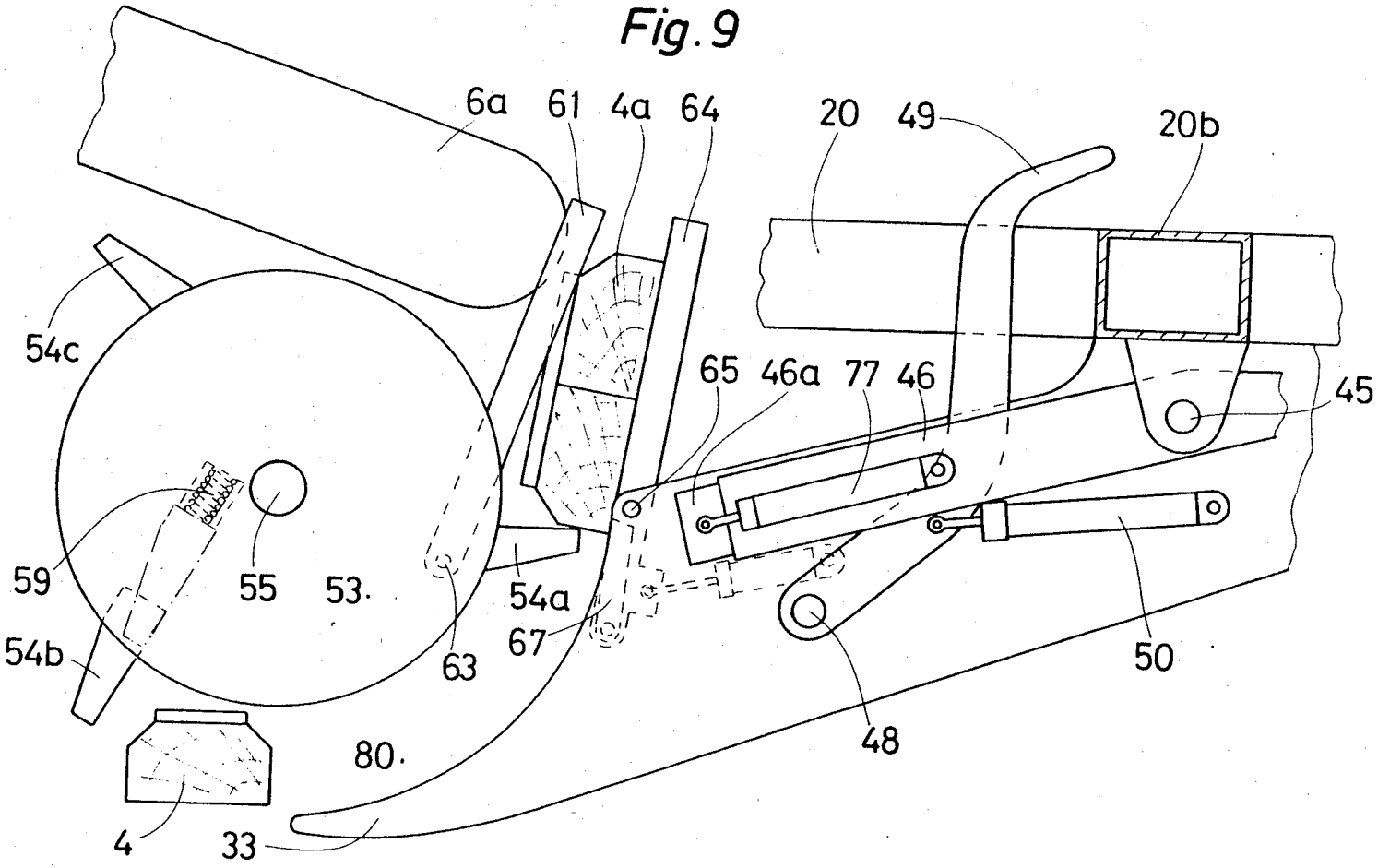
FIGS. 9–12 are schematic side views showing the machine of FIG. 7 during different successive steps of its operation, wherein only the parts necessary for the proper understanding of the invention are illustrated on a larger scale.
Figure 10:
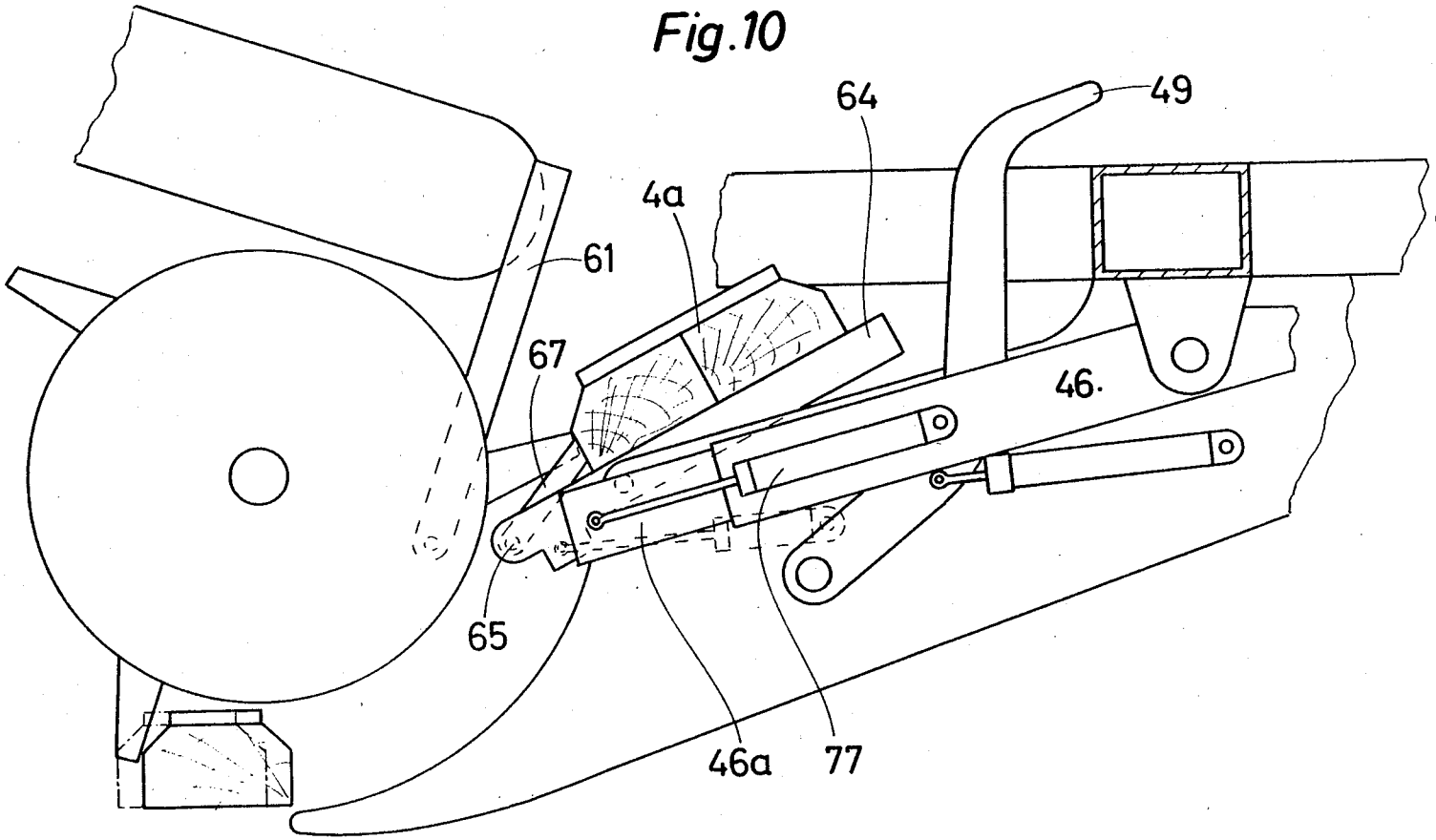
Figure 11:
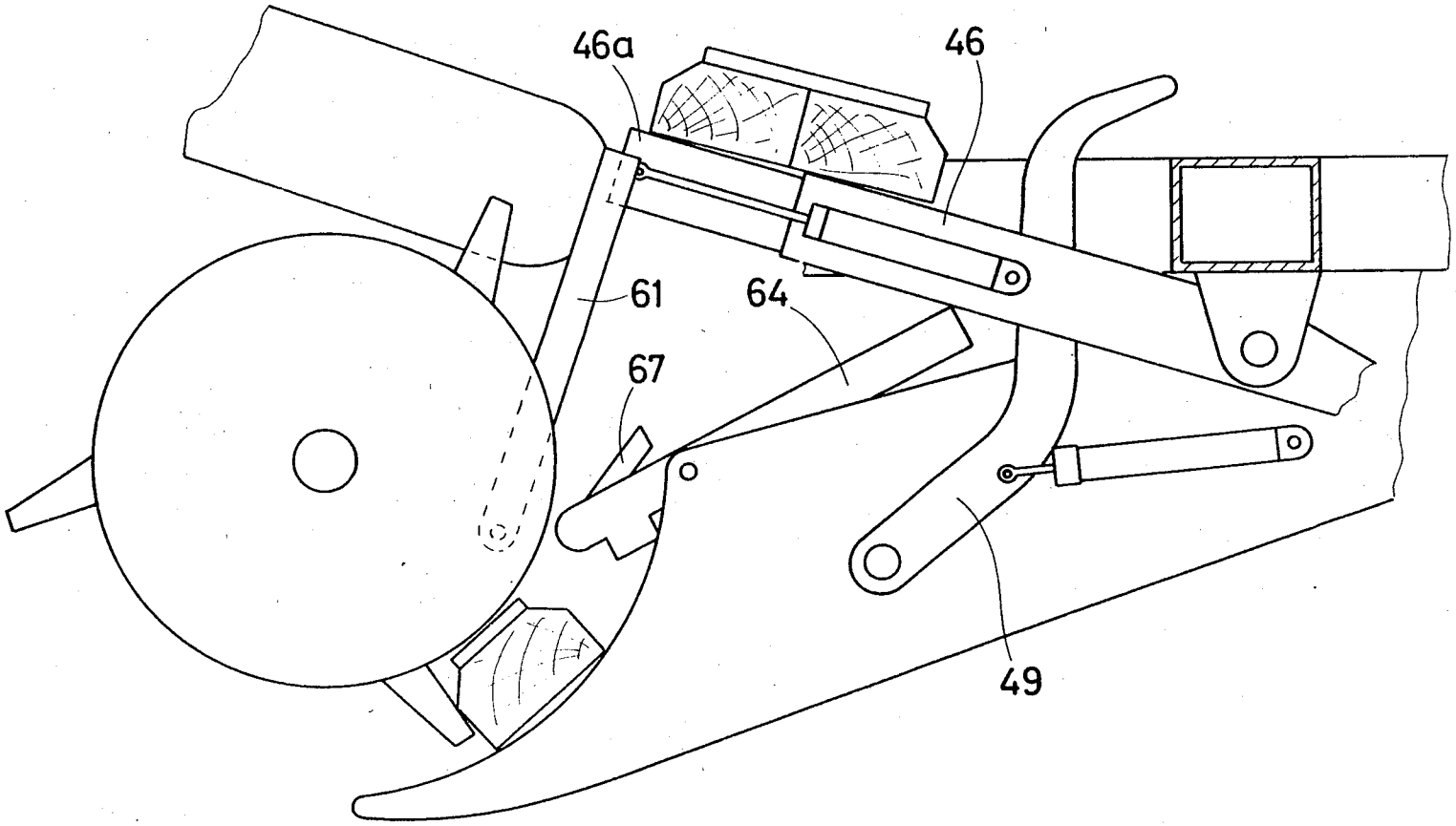

According to FIG. 9, the double tie 4*a* of FIG. 7 is moved forwards and lifted by push finger 54*a* as a consequence of the corresponding rotation of wheel 53 to such an extent that it eventually lies between guide rails 61 and guide lever 64, however without clearing the area of pawls 67, which are pushed aside by the passage of the tie. Simultaneously, the machine has travelled forward to such an extent that the following push finger 54*b* is positioned behind the next tie 4 to be picked up, this tie being a single one. In case the push finger either meets an excessive resistance when it is sunk into the ballast or strikes the tie from behind, or strikes only a heavy, insuperable obstacle, the push finger concerned will be retracted against the force of spring 59 of FIG. 9, as shown in dash lines in FIG. 9.

From the position shown in FIG. 9, the double tie 4*a* will be driven further by push finger 54*a* until it overlies the pawls 67 which, responsive to their springs 69, will snap out again and thus prevent a possible backward slipping of the double tie 4*a* when the push finger 54*a* clears the pawls due to the continuous rotation of wheel 53. According to the thickness of the tie engaging the guide lever 64, the guide rails 61 can yield more or less against the force of their springs 62. After the double tie 4*a* has been driven sufficiently by push fingers 54*a*, the guide levers 64 are lowered counterclockwise, as seen in FIG. 10, by hydraulic cylinder 66, this Figure showing a temporary position of guide lever 64 supporting the double tie 4*a*.

When the guide lever 64 has attained its lower, slightly inclined position (FIG. 14), in which the bottom of the tie is substantially level with the upper face 33*b* of ramp 33 and overlies directly or rests upon the tie lifting member 46 now in its lower position, this tie lifting device will be pivoted upwards in order to lift the tie up to the level of belt conveyor 6*a*.

FIG. 10 shows the condition obtained shortly before this position is reached. Just before dropping a tie upon the tie lifting member 46 kept in its lower position, its telescopic sections 46*a*, if necessary, will be pulled out so far that the double tie 4*a* will be lowered substantially throughout its width on the tie lifting member 46 so as to lay safely thereon during the upward stroke. In the upper position, shown in FIG. 11, of the tie lifting member 46 the telescopic sections 46*a* thereof are fully extracted in order to bridge the gap left between the member 46 and the belt conveyor 6*a*. During the lifting of the tie by the tie lifting member 46 the wheel 53 is rotated so that push finger 54*b* will drive the next tie 4 further on, and at the same time the guide lever 64 is tipped back to its strongly upwardly inclined initial position.

After the tie lifting member 46 has attained its uppermost position shown in FIG. 12, the tie pusher 49 becomes operative and pushes the double tie 4*a* on belt conveyor 6*a*. Meanwhile, the guide levers 64 have resumed their upper, strongly upwardly inclined position, so that the next tie 4, as a consequence of the rotation of wheel 53, is positioned between the guide rails 61 and the guide levers 64, and the above-described cycle can be repeated. As soon as the double tie 4*a* is taken over by conveyor 6*a*, the tie lifting member 46, while retracting its telescopic sections 46*a*, is pivoted back to its inoperative position and the tie pusher 49 resumes its initial position.

The above-described form of embodiment of a tie removal machine makes it possible, through guideway 80, to guide upwards in a particularly safe manner the ties removed from the ballast and then, by lowering the guide lever 64, to such intermediate position from which they can be picked up from the tie lifting member 46 with the proper orientation for the purpose, so as to transfer them further on. For this purpose, as a rule the retractable pawls 67 are not necessary, since for raising a tie sufficiently and preventing it from falling back the push finger of wheel 53 which engages the tie is sufficient, and the guide lever 64 with the tie theron can be lowered before the push finger concerned moves away from the tie as the wheel 53 continues its rotation. However, the pawls 67 provide as a rule a greater degree of safety and permit more particularly of transferring continuosly two individual ties transported in the gap formed between guide rails 61 and guide levers 64, by means of these guide levers 64, then tie lifting member 46 and finally tie pusher 49, to the belt conveyor 6*a*. With this mode of operation, firstly a separate or single tie is raised to a level beyond the pawls 67, whereafter the tie engaged by these pawls from beneath is held in position, and then, without actuating the guide lever 64, the next push finger will lift a second single tie until, while carrying along and raising further the first tie, the level of guide lever 64 is attained, so that now the two ties disposed one upon the other abut the guide levers 64, which will be lowered. According to this working procedure, the same number of ties per time unit can be removed and transferred with only one-half of the frequency of operating cycles of members 64, 46 and 49.

During the machine operation and the forward travel thereof, the wheel 53 may be driven at a substantially uniform velocity, but a step-by-step or irregular rotational speed may also be adopted as a function of working conditions.

The entire ramp 33 with the component element secured thereto can pivot about a shaft 82 journalled in brackets 20*g* rigid with cross member 20*b* (FIG. 8), this pivotal movement taking place counterclockwise as shown in FIG. 7. For this purpose, a hydraulic cylinder 81 is pivotally connected at one end to the rear area of ramp 33 and at the other end to a bracket 20*h* carried by cross member 20*b*. Thus, the ramp 33 can be moved with the assistance of hydraulic cylinder 81 on the one hand for vertical adjustment and can on the other hand, upon completion of the working procedure, be lifted out from the ballast and set in an inoperative position, notably for travelling from one working site to another.

Figure 15:
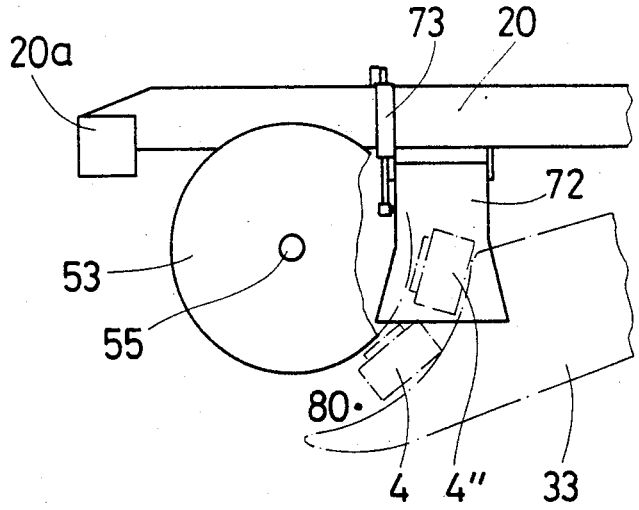
FIG. 15 shows a simplified side elevational view of the machine of FIG. 7 with the tie aligning means.
Figure 16:
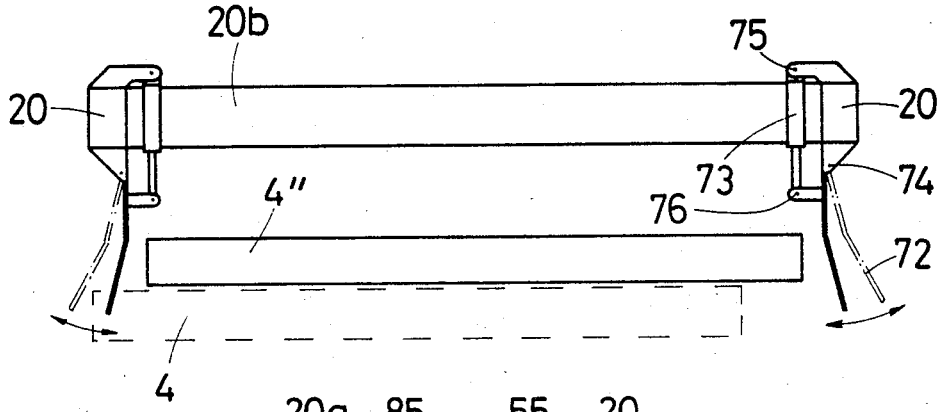
FIG. 16 is a diagrammatic front elevational view of the tie aligning means.

In order to obtain a lateral alignment of the ties 4 extracted from the ballast, the last-described machine is advantageously provided with a tie aligning device shown diagrammatically in FIG. 15 and 16 and also in FIG. 8, this device being omitted from FIG. 7 for the sake of clarity. This device comprises on both sides of the machine substantially vertically disposed plates 72 slightly bent outwards and hingedly mounted to the corresponding sides of the machine frame 20 about a longitudinally extending axis 74 so that they can pivot in the direction of the double arrows of FIG. 16. With the assistance of a hydraulic cylinder 73 pivotally connected at one end to the machine frame 20 about an axis 75 and at the other end by means of a pivot pin 76 to a lug projecting from the inner face of plate 72, each plate 72 can be moved from the slightly outward inoperative position shown in dash and dot lines in FIG. 16 inwards to the position shown in solid lines, when a tie 4 removed from the ballast is lifted and driven up the guideway 80. Thus, a tie 4 which, as shown in dash lines in FIGS. 15 and 16, is shifted laterally in relation to the longitudinal centre line of the machine, during its upward travel, is moved laterally by said plates 72 toward the centre until it assumes a central position, as shown in solid lines in the case of tie 4''. Consequently, one is assured that the ties are properly fed in a laterally centered or central position when delivered to the belt conveyor 6*a*.

Figure 17:
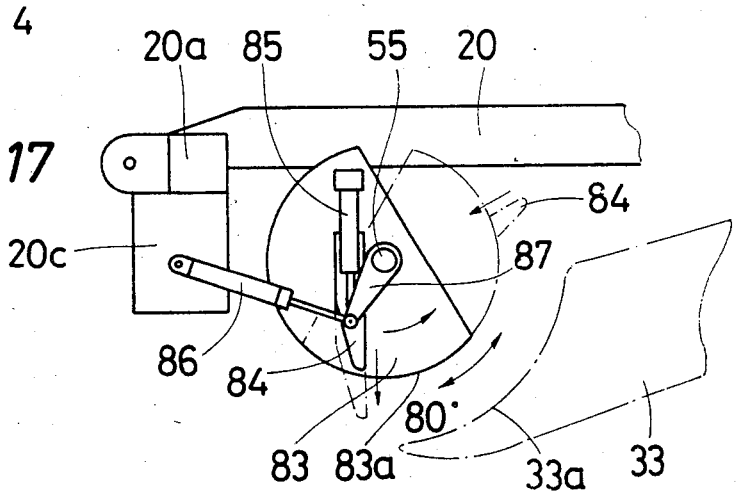
FIG. 17 is a fragmentary side elevational view of a fourth form of embodiment with a different driving member.

FIG. 17 shows a fourth form of embodiment which differs from the form of embodiment of FIGS. 7 to 16 simply by the fact that the driving member 83—as in the example shown in FIGS. 2 to 5—perform a rotary reciprocating motion about shaft 55 in the direction of the double arrow and has the shape of a segment of a circle which is somewhat larger than a half-circle. It can also have approximately the shape of a circular segment extending along an angle of less than 180°. This driving member 83, as in the case of the first form of embodiment, is provided with a single push finger 84 which, by means of a hydraulic cylinder 85, is adjustable between the working position shown in dash lines in FIG. 17 and inoperative position shown in thick lines, as already explained with reference to the first form of embodiment for the pushfinger 32 actuated by hydraulic cylinder 40. The driving member 83 is driven to and fro by a hydraulic cylinder 86 pivotally connected at one end to the front side 20*a* of the machine frame 20 and at the other end to a bracket 87 secured to the shaft 55. For extracting and lifting a tie the driving member 83 will be rotated counter clockwise with the projecting push-finger 84 engaging the tie from behind in the direction of the arrow of FIG. 17 until it reaches the position illustrated, whereby the peripheral area 83*a* of the driving member which, in the direction of the thrust exerted by push-finger 84, faces this finger, constitutes the upper limit of said guideway 80. Subsequently, the tie is lowered by guide level 64 (not shown in FIG. 17) and thus conveyed further away, as already explained with reference to FIGS. 7–12. All the remaining parts, not shown in FIG. 17, of this fourth form of embodiment of the machine and their functions correspond to those of the third form of embodiment shown in FIGS. 7–16. This applies notably to the already cited guideway 80, guide rails 61, guide lever 64, tie lifting device 46 and tie-pusher 49, as well as to the pivotal suspension of driving member 83 by means of arms 24 and hydraulic cylinder 70 shown in FIG. 13.

The thus described tie removal machine according to the invention enables the operator sitting on the machine and supervising the works, to control manually the working movements of driving members 31, respectively 53, respectively 83, which can thus be adapted separately, while the machine travels at a uniform speed, to the frequently varying distance between ties, as well as to the frequently encountered double-ties. The tie lifting member 46 and tie pusher 49, as well as guide lever 64 (if provided), may in general and advantageously be controlled automatically in accordance with the manually controlled movement of the driving member, since the individually controlled transfer of the ties from the track ballast to the ramp 33, the lifting of the ties and finally the transfer of the lifted ties to the belt conveyor are effected by means of separate members, the jamming of ties is practically excluded and a trouble-free removal of ties of all kinds, independently of their condition and of the condition of the track ballast, is safely obtained on both straight and curved track sections. Thus, ties made of different materials, such as wooden, concrete and steel ties, can be removed. In addition the ties, during their transport on the belt conveyor, are not turned upside down, so that the base plates or corrugated plates possibly secured to the top surface of the ties preserve their topmost position even when the ties are deposited upon the conveyor; therefore, any subsequent turning of the ties, before gathering them in the usual way on a flat car, can be dispensed with. In this way, the tie obviously rest also more safely on the conveyor. Furthermore, by virtue of the possibly contemplated guide plates 26 or aligning device of FIGS. 15 and 16, ensures the lateral guiding of the ties, respectively the centering thereof during the transfer on ramp 33, respectively a discrete guiding thereof during their lifting step.

The invention is obviously not limited by the above-described exemplary forms of embodiment, since many changes may be brought to the shape and arrangement of the driving members as well as of the other component elements controlling the tie movements, and also the shape and arrangement of the ramps and guide paths for ties.

What is claimed is:

1. Travelling railroad tie removal machine comprising a frame, bogies for supporting said frame for movement in a forward direction above a railroad bed from which ties are to be removed, a pair of laterally spaced ramps supported below said frame in stationary position, said ramps having upper surfaces inclined upwardly and rearwardly relative to the forward direction of movement of said frame, means for extracting ties from said railroad bed and pushing them onto said ramps, said extracting means comprising laterally spaced driving members rotatable about a horizontal axis and push fingers on said driving members for engaging said ties, a belt conveyor mounted on said frame above said ramps, said conveyor having a tie-receiving end above said ramps and extending from said end forwardly relative to the forward direction of movement of the machine, means for lifting ties from said ramps to the level of said belt conveyor, said lifting means comprising spaced lifting levers rotatable about a horizontal axis between a lower position in which they lie below said upper surfaces of said ramps and an upper position in which they are at the level of said conveyor and means for pushing ties from said lifting levers when in said upper position onto said conveyor.

2. Railroad tie removal machine according to claim 1, in which said pushing means comprises power operated push levers pivotal about an axis below the upper surfaces of said ramps and movable between a retracted position and a projected position in which they push a tie from said lifting means onto said conveyor.

3. Railroad tie removal machine according to claim 2, in which said push levers are S-shaped with convex tie-engaging portions.

4. Railroad tie removal machine according to claim 1, in which means is provided for raising and lowering said horizontal axis of said driving members.

5. Railroad tie removal machine according to claim 1, in which said push fingers are retractable radially of said driving members between an extended position and a retracted position, and in which means is provided for moving said push fingers to said extended position.

6. Railroad tie removal machine according to claim 1, in which said driving members have arcuate peripheries with said push fingers projecting radially outwardly from said peripheries and in which said ramps have arcuate upwardly concave upper surfaces forming with said arcuate peripheries of said driving members curved guide channels for said ties as they are pushed by said push fingers onto and along said ramps.

7. Railroad tie removal machine according to claim 1, in which said driving members comprise wheels rotatable about a horizontal axis, means for driving said wheels in rotation and at least one radially retractable push finger projecting from the periphery of each of said wheels, said wheels being positioned with their peripheries spaced from upper surfaces of respective ramps to form between the peripheries of said wheels and upper surfaces of respective ramps guide channels for said tie as they are pushed by said push fingers onto and along said ramps.

8. Railroad tie removal machine according to claim 7. in which upper surfaces of said ramps are upwardly arcurately concave to form with peripheries of said wheels curved guide channels for said ties.

9. Railroad tie removal machine according to claim 7, in which there are a plurality of circumferentially spaced push fingers on each of said wheels, said wheels being unidirectional in rotation.

10. Railroad tie removal machine according to claim 1, in which each of said driving members comprises a member having the shape of a segment of a circle with an arcuate periphery and a push finger projecting from the periphery, said members being positioned with their peripheries spaced from respective ramps to form between said peripheries and upper surfaces of respective ramps guide channels for said ties as they are pushed by said push fingers onto said ramps.

11. Railroad tie removal machine according to claim 10, in which said segment-shaped members are rotated in one direction from an initial position to push a tie onto said ramps and are then rotated in the opposite direction back to said initial position.

12. Railroad tie removal machine according to claim 10, in which upper surfaces of said ramps are upwardly arcuately concave to form with peripheries of said segment-shaped members curved guide channels for said ties.

13. Railroad tie removal machine according to claim 1, in which each of said driving members comprises a drive lever oscillatable about a horizontal axis and having a push finger projecting from a free end thereof, said extracting means further comprising power means for swinging said drive levers about their axis in one direction from an initial position to push a tie onto said ramps and in the opposite direction back to said initial position.

14. Railroad tie removal machine according to claim 13, further comprising guide plates having peripheries spaced from respective ramps to form between said peripheries of said guide plates and upper surface of said ramps guide channels for ties as they are pushed by said push fingers onto said ramps.

15. Railroad tie removal machine according to claim 14, in which said driving members and guide plates are mounted for movement up and down and in which power means is provided for moving said driving members and guide plates up and down.

16. Railroad tie removal machine according to claim 13, in which said push finger is retractable relative to the respective drive lever and in which means is provided for moving said push finger between a retracted position and an extended position.

17. Railroad tie removal machine according to claim 1, further comprising laterally spaced guide levers pivotal about a horizontal axis below upper surfaces of said ramps and power means for moving said guide levers between a slightly inclined position and a steeply inclined position for guiding ties as they are lifted by said lifting levers.

18. Railroad tie removal machine according to claim 17, further comprising spring biased pawls pivotally mounted on said guide levers for engagement with ties guided by said guide levers to prevent retrogressive movement of said ties.

19. Railroad tie removal machine according to claim 17 further comprising laterally spaced guide rails mounted for pivotal movement about an axis disposed forwardly of the axis of said guide levers with reference to the forward direction of movement of said frame and spring biased toward said guide levers when the latter are in steeply inclined position, said guide rails and respective guide levers being spaced apart to define a guideway for ties being lifted by said lifting levers.

20. Railroad tie removal machine according to claim 1, in which said ramps are mounted for pivotal movement about a horizontal axis and in which power means is provided for setting said ramps at selected working heights relative to said frame and for raising said ramps to inoperative positions for transport of said machine.

21. Railroad tie removal machine according to claim 1, further comprising means engageable with ends of ties as they are being lifted to align said ties laterally of said machine.

22. Railroad tie removal machine according to claim 1, in which said lifting levers have telescopic extension elements and hydraulic cylinders for moving said extension elements telescopically to vary the effective length of said lifting levers.

* * * * *